United States Patent [19]

Saegusa

[11] Patent Number: 4,805,436

[45] Date of Patent: Feb. 21, 1989

[54] APPARATUS FOR BENDING METAL TUBE OF SMALL DIAMETER

[75] Inventor: Shigeru Saegusa, Shizuoka, Japan

[73] Assignee: Usui Kokusai Sangyo Kabushiki Kaisha, Nagasawa, Japan

[21] Appl. No.: 120,084

[22] Filed: Nov. 12, 1987

[51] Int. Cl.[4] ..... B21D 7/024

[52] U.S. Cl. ..... 72/306; 72/311

[58] Field of Search ..... 72/306, 307, 311, 323, 72/321, 215–219, 149

[56] References Cited

U.S. PATENT DOCUMENTS

| | | | |
|---|---|---|---|
| 2,964,085 | 12/1960 | Ghiringhelli | 72/306 |
| 3,606,786 | 9/1971 | Taylor | 72/321 |
| 4,090,387 | 5/1978 | Dubreuil | 72/217 |
| 4,471,819 | 9/1984 | Nihashi | 72/306 |

FOREIGN PATENT DOCUMENTS

| | | | |
|---|---|---|---|
| 1943516 | 4/1971 | Fed. Rep. of Germany | 72/216 |
| 151045 | 9/1981 | German Democratic Rep. | 72/217 |
| 607617 | 5/1978 | U.S.S.R. | 72/306 |

*Primary Examiner*—Daniel C. Crane

*Attorney, Agent, or Firm*—Anthony J. Casella; Gerald E. Hespos

[57] ABSTRACT

An apparatus for bending a metal pipe having a small diameter includes a pipe retaining mechanism and bending units. The pipe retaining mechanism comprises a pair of chucks consisting of a split pattern provided on a support. One of the chucks is fixed and the other is mounted on the distal end of a piston rod of a cylinder device in such a manner that it opposes the one of the chucks. The bending units are provided on the support on two sides of the pipe retaining mechanism in the crosswise direction thereof, and has forming rolls supported to fixtures on the support on two sides of the extension of the axis of the pipe retaining mechanism, as well as press rolls which are pivotal about the forming rolls. The support is fixed to the upper end of a drive shaft rotated in cooperation with a piston rod of a cylinder device on a base, so that the bending apparatus on the support can be pivoted on the plane of the support during bending process.

4 Claims, 3 Drawing Sheets

APPARATUS FOR BENDING METAL TUBE OF SMALL DIAMETER

BACKGROUND OF THE INVENTION

1. Field of the Invention:

The present invention relates to an apparatus for bending a metal tube at two locations in substantially opposite directions at one time, the metal tube having a relatively small diameter such as about 15 m/m and mainly used as a passageway for supplying oil or air in automobiles, various machines or industrial equipment.

2. Description of the Prior Art:

Known bending apparatuses of this type include a support, a section for retaining a pipe by a chuck connected to a cylinder device, and bending units each of which has a forming roll and a press roll connected to a rotary actuator provided on the bottom of the support so that it pivots around the forming roll, the retaining section and the bending units being provided on the support. Such a bending apparatus is operated as described below and as illustrated in FIG. 7: a pipe P' is retained at a section 21 for retaining it by a chuck 20 provided on a fixed type support, and the pipe is bent in that state at two locations in substantially opposite directions by pivoting press rolls 24 and 24' of bending units 22 and 22' disposed on the support in the vicinities of two sides of the retaining section in crosswise direction, about forming rolls 23 and 23' by respective rotary actuators (not shown) in the direction indicated by arrows.

In this bending apparatus, a pipe is bent by the bending units 22 and 22' alone on the fixed support. Therefore, when the pipe P' to be bent is a long one and it is bent in the vicinity of its mid point, the two ends of the pipe are shifted through a large distance, increasing possibilities of the pipe P' being deformed and scratched and of the plated layers being damaged or cracked. Further, installation of the bending apparatus requires large space.

SUMMARY OF THE INVENTION

Accordinly, an object of this invention is to provide an apparatus for bending a metal pipe having a small diameter which is capable of obviating the above-described problems of the prior art. In this bending apparatus of this invention, the support is fixed to a drive shaft connected to a cylinder device provided on a separate base, and the entire bending apparatus disposed on the support is made pivotal on the plane of the support. When the pipe is bent, it is bent by the bending units while the support is being pivoted. As a result, degree of deviation of the two sides of the pipe is decreased, thereby minimizing occurrence of deformation or scratch imparted to the pipe, or damage or crack of the plating coated on the outer periphery of the pipe. Further, operating efficiency of the apparatus is increased, and installation of the apparatus in a relatively small space is made possible.

The bending apparatus of this invention includes: a pipe retaining section incorporating a chuck which consists of a split pattern, one of the split pattern which acts as a receiving member being fixed to the upper surface of a support and the other pressing member being mounted on the distal end of a piston rod of a cylinder device; and bending units disposed on the support in the vicinities of two sides of the retaining section in crosswise direction, the bending units having forming rolls supported to fixtures on the support on two sides of the extension of the axis of the retaining section and press rolls connected to respective rotary actuators provided on the bottom surface of the support so that they can pivot about the corresponding forming rolls. The support is fixed to the upper end of a drive shaft connected to a piston rod of a cylinder device provided on a base, and the entire bending apparatus on the support is made pivotal on the plane of the support. When bending is conducted, the pipe is bent by the bending unit while the support is being pivoted.

DETAILED DESCRIPTION OF THE PREFERRED EMBODIMENTS

Figure 1:
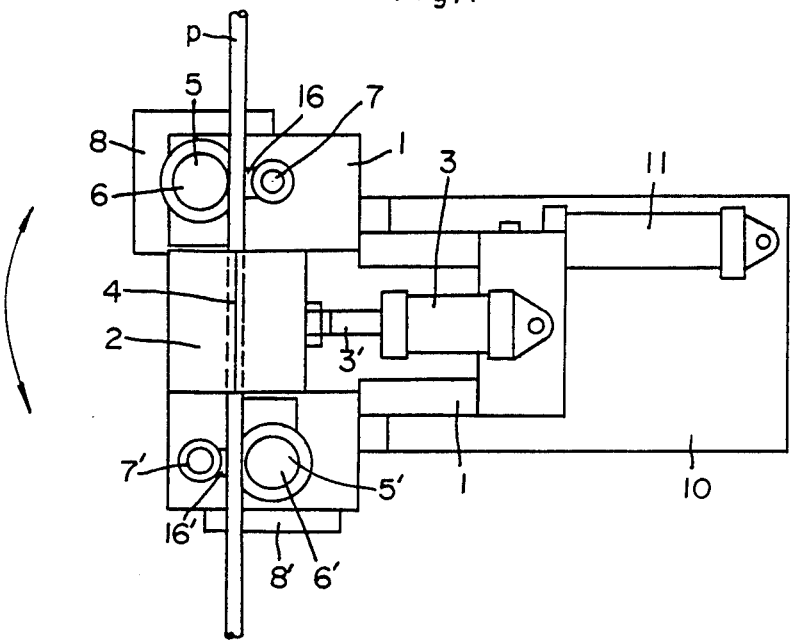
FIG. 1 is a plan view of an apparatus for bending a metal tube having a small diameter, showing an embodiment of this invention.
Figure 2:
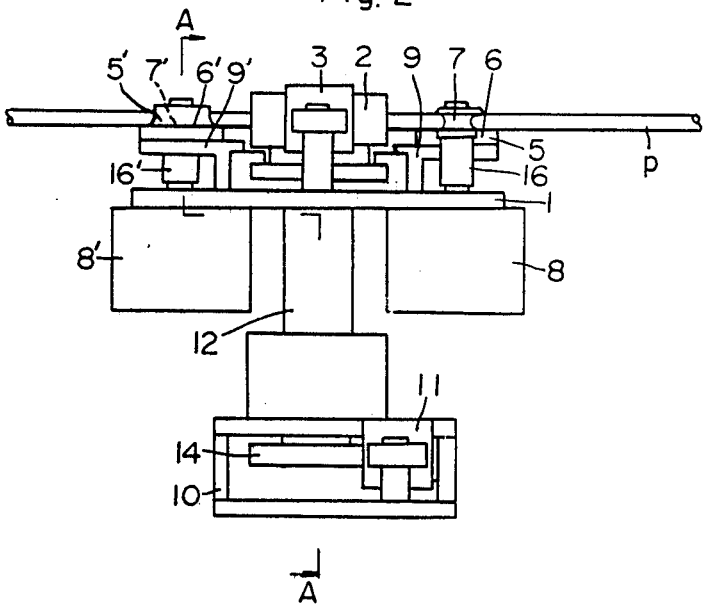
FIG. 2 is a front elevational view of the apparatus of FIG. 1.
Figure 3:
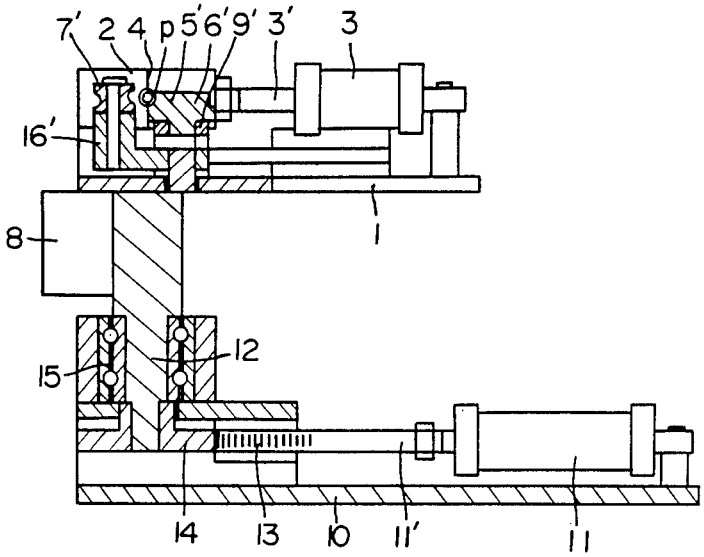
FIG. 3 is a cross-section taken along the line of A—A of FIG. 2.

The present invention will be described below with reference to FIGS. 1 to 6. To construct a retaining section 4 which retains the straight portion of a pipe P to be processed, one of the molds of a chuck 2 consisting of two split molds which acts as a receiving member is fixed to a support 1. The other mold of the chuck which acts as a pressing member is mounted on the distal end of a piston rod 3' of a cylinder device 3 in such a manner that it opposes the first mold. Bending units 5 and 5' are disposed on the support 1 in the vicinities of the two sides of the retaining section 4 in the crosswise direction thereof. The bending units 5 and 5' includes forming rolls 6 and 6' supported to fixtures 9 and 9' fixed to the support 1 on two sides of the extension of the axis of the retaining section 4, and press rolls 7 and 7' pivoted about the corresponding forming rolls 6 and 6'. The press rolls 7 and 7' are coupled to corresponding rotary actuators 8 and 8' provided on the bottom surface of the support 1 through levers 16 and 16' so that they can pivot integrally with the rotary actuators 8 and 8'. Reference numberal 10 denotes a base which supports a drive shaft 12 by means of a bearing 15. A gear 14 engaged with a rack 13 of a piston rod 11' of a cylinder device 11 provided on the base is fixed to the lower end of the drive shaft 12. The support 1 is fixed to the upper end of the drive shaft 12, so that the whole bending apparatus on the support is made pivotal in the plane of the support 1 and that bending is conducted by the pivot of the support 1 as well as by the operation of the bending units 5 and 5'.

Figure 4:
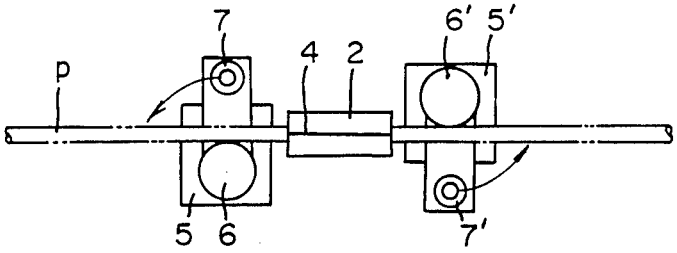
FIGS. 4, 5, and 6 show how bending units of the apparatus of FIG. 1 are operated to bend a pipe.

The arrows indicate directions in which the whole bending apparatus provided on the support 1 is pivoted by the actuation of the cylinder device 11 and in which a pipe is turned by the bending units 5 and 5', the bending process being conducted concurrently with the pivot of the bending apparatus (see FIG. 4).

Figure 5:
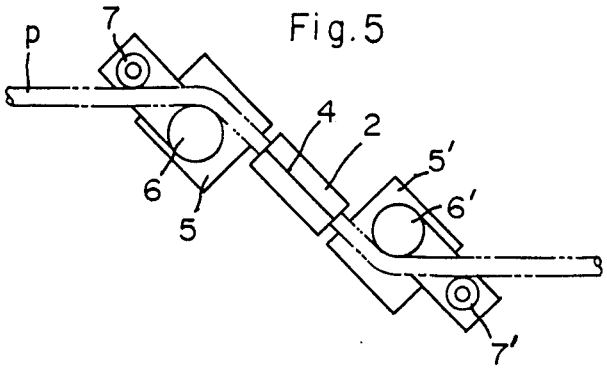
Figure 6:
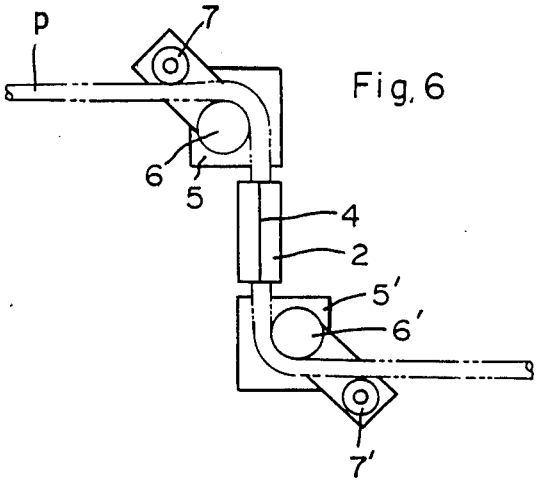
Figure 7:
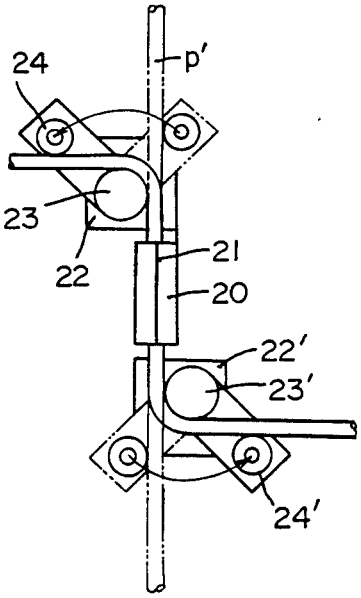
Fig.7 PRIOR ART
FIG. 7 illustrates the bending operation of the bending units of a known bending apparatus.

The operation of the thus-arranged bending appratus of this invention will now be described with reference to FIGS. 4 to 6. A pipe P is set on the apparatus by positioning it at the retaining section 4 which incorporates the chuck 2 provided on the support and by locating it between the adjacent forming rolls 6 and 6' and press rolls 7 and 7' of the bending unit 5 and 5'. The pipe P is then gripped in this state by the retaining section 4 by the actuation of the cylinder device 3 (see FIG. 4). Subsequently, the whole bending apparatus on the support is pivoted through a desired angle on the plane of the support 1 by pivoting the support 1 by operating the cylinder device 11 mounted on the base, while the press rolls 7 and 7' of the bending units 5 and 5' are pivoted through a desired angle in substantailly two opposite directions about the forming rolls 6 and 6' by the actuation of the corresponding rotary actuators 8 and 8' (see FIGS. 5 and 6).

In other words, while the whole bending apparatus on the support 1 is made pivotal on the plane of the support, and bending process is conducted by the bending units 5 and 5' while the support 1 is being pivoted.

As will be clear from the foregoing description, in the appratus for bending a metal pipe having a small diameter, since the support 1 is fixed to the drive shaft 12 coupled to the cylinder device 11 mounted on the base 10 and the whole bending apparatus on the support is made pivotal on the plane of the support, the two ends of the pipe P are only moved substantially parallel by the pivot of the support and are not deviated through a large distance. As a result, occurrence of deformation or scratch of the pipe P or damage or crack of the plated layer on the outer periphery of the pipe can be reduced. At the same time, operating efficiency of the apparatus is increased, and installation of the apparatus in a small space is enabled.

What is claimed is:

1. An apparatus for bending a metal pipe having a small diameter including: a pipe retaining mechanism comprising a pair of chucks consisting of a split pattern provided on a support, one of said chucks being fixed and the other being mounted on the distal end of a piston rod of a cylinder device in such a manner that it opposes said one of the chucks; and pipe bending units provided on said support on two opposed sides of said pipe retaining mechanism in the crosswise direction thereof, said bending units having forming rolls supported to fixtures on said support on two opposed sides of an extension of the axis of said pipe retaining mechanism, and press rolls which are pivotal about said respective forming rolls, wherein the improvement is characterized in that said support is fixed to the upper end of a drive shaft rotated in cooperation with a piston rod of a cylinder device on a base, said support being a single rigid platform with each press roll being pivotal about said respective forming rolls relative to said support and said support being rotatable by said drive shaft relative to said base such that said pipe retaining mechanism and said bending units on said support are pivoted in the plane of said support to bend spaced apart portions of said pipe in opposed directions with substantially minimal swinging of the bent portions of the pipe during bending process.

2. An apparatus for bending a metal pipe according to claim 1, wherein said piston rod of said cylinder device cooperates with said drive shaft through engagement of a gear provided on said drive shaft with a rack provided on said piston rod.

3. An apparatus for bending a metal pipe according to claim 1, wherein said press rolls are pivoted about said corresponding forming rolls by rotary actuators provided on the bottom surface of said support.

4. An apparatus for bending a metal pipe including: a support; a pipe retaining mechanism for retaining metal pipe in a linear relationship relative to said support on both sides of said retaining mechanism mounted on said support; and a pair of pipe bending units mounted in spaced relation to said retaining mechanism on said support on two opposed sides of said pipe retaining mechanism, said bending units having pipe forming rolls supported to fixtures on said support on two opposed sides of an extension of an axis of a pipe secured in said pipe retaining mechanism, said bending units further comprising press rolls pivotable about the respective forming rolls, wherein the improvement is characterized in that said support is fixed to drive means mounted on a base for rotating said support and the pipe retaining mechanism and bending units mounted on said support in the plane of said support to bend spaced apart portions of the pipe in opposed directions with substantially minimal swinging of the bent portions of the pipe during a bending process and said support is a single rigid platform with each press roll being pivotal about said respective forming rolls relative to said support and said support is rotatable by said drive means relative to said base.

* * * * *